United States Patent [19]

Cowan et al.

[11] 4,313,845

[45] Feb. 2, 1982

[54] SYSTEM FOR CHEMICALLY DIGESTING LOW LEVEL RADIOACTIVE, SOLID WASTE MATERIAL

[75] Inventors: Richard G. Cowan, Kennewick; Albert G. Blasewitz, Richland, both of Wash.

[73] Assignee: The United States of America as represented by the United States Department of Energy, Washington, D.C.

[21] Appl. No.: 98,109

[22] Filed: Nov. 28, 1979

[51] Int. Cl.[3] ..... G21F 9/28; G21F 7/06

[52] U.S. Cl. ..... 252/630; 422/159; 422/184; 422/231; 422/903; 252/631

[58] Field of Search ..... 252/301.1 W; 422/159, 422/184, 903

[56] References Cited

U.S. PATENT DOCUMENTS

| | | | |
|---|---|---|---|
| 3,557,013 | 1/1971 | Detilleux et al. | 252/301.1 W |
| 3,776,856 | 12/1973 | Scheffler et al. | 252/301.1 W |
| 3,957,676 | 5/1976 | Cooley et al. | 252/301.1 W |
| 3,958,948 | 5/1976 | Kilian | 422/159 |
| 4,124,525 | 11/1978 | Bornes et al. | 252/301.1 W |

OTHER PUBLICATIONS

Carter et al., *Management of Low-Level Radioactive Waste, vol. 1,* Pergammon Press, New York (1979), pp. 254–257.

Perry, *Chemical Engineers' Handbook 3rd Ed.,* McGraw-Hill Book Co., Inc. New York, (1950), pp. 1203–1204.

Lerch et al., "Treatment of Alpha-Bearing Combustible Wastes Using Acid Digestion", Chem. Abs., vol. 89 (1978): 117179u.

*Primary Examiner*—Deborah L. Kyle

*Attorney, Agent, or Firm*—Daniel C. Abeles

[57] ABSTRACT

An improved method and system for chemically digesting low level radioactive, solid waste material having a high through-put. The solid waste material is added to an annular vessel (10) substantially filled with concentrated sulfuric acid. Concentrated nitric acid or nitrogen dioxide is added to the sulfuric acid within the annular vessel while the sulfuric acid is reacting with the solid waste. The solid waste is mixed within the sulfuric acid so that the solid waste is substantilly fully immersed during the reaction. The off gas from the reaction and the products slurry residue is removed from the vessel during the reaction.

8 Claims, 1 Drawing Figure

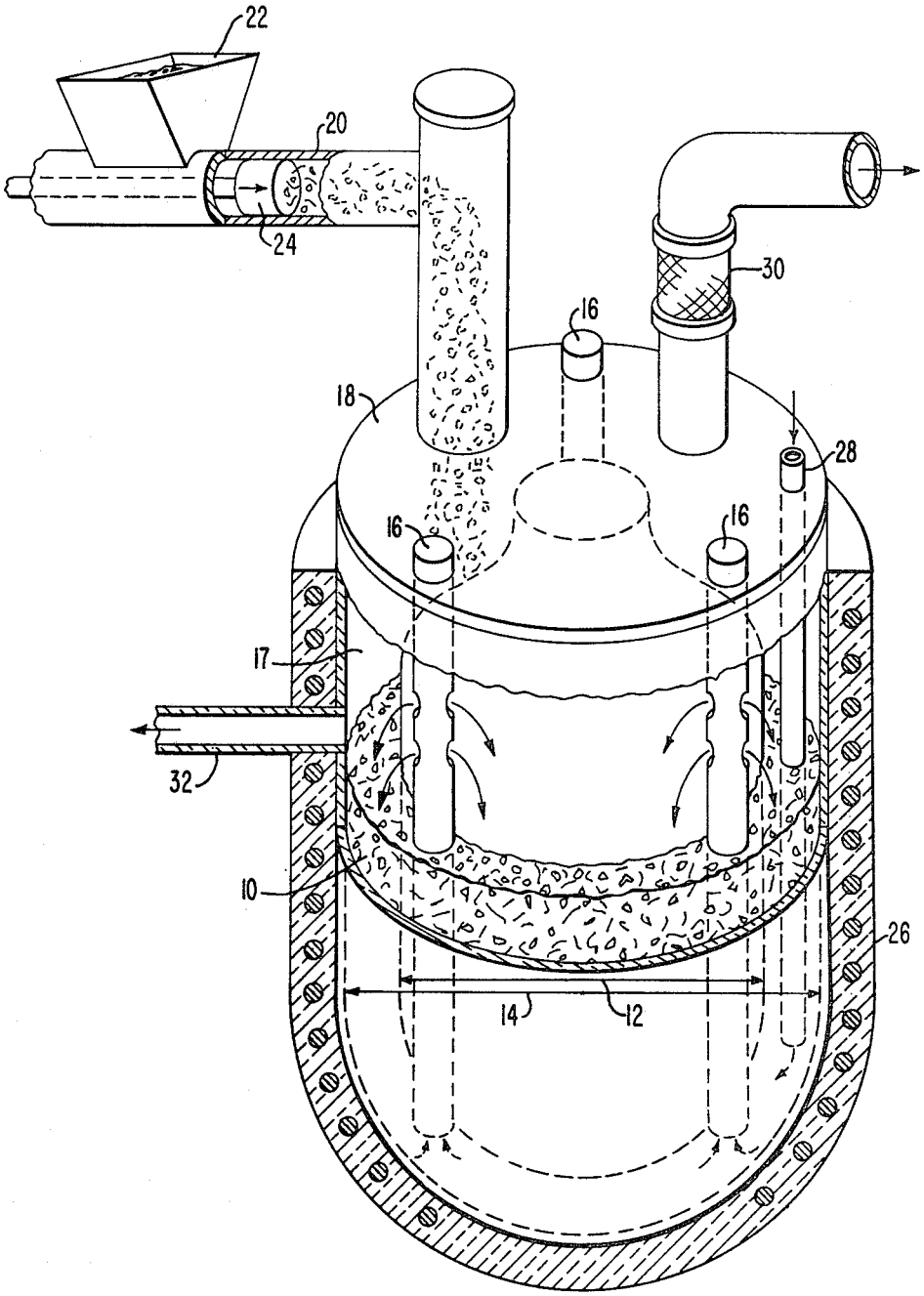
22
20
24
30
16
18
28
16
16
17
32
10
26
14
12

SYSTEM FOR CHEMICALLY DIGESTING LOW LEVEL RADIOACTIVE, SOLID WASTE MATERIAL

BACKGROUND OF THE INVENTION

The invention described herein was made in the course of, or under a contract with the United States Department of Energy. The invention relates generally to acid digestion processes and more particularly to the chemical digestion of combustible, low level radioactive, solid waste material.

Disposal of radioactive waste is an important problem in the nuclear energy field today since many radioactive wastes must be stored for very long time periods to assure that no health hazard will be incurred. Low level radioactive, combustible, solid waste materials are a particular problem because of the relatively large bulk of such materials associated with small amounts of contamination. Typical combustible, solid waste materials of concern are those resulting from fuel fabrication operations, such as used rubber gloves, paper, rags, brushes and various plastics. Of particular concern as well is the disposal of spent ion exchange resins from reactors, fuel fabrication plants and reprocessing plants (e.g. estimated to comprise from 500 to 800 cubic feet of material per year per nuclear reactor).

Present practice consists of packaging the solid waste materials in containers ranging from cardboard boxes lined with plastic bags to steel drums and then burying the packages in pits or trenches. This technique involves transporting the packaged materials over roadways and finally storing the materials in monitored repositories. Potential release of contamination to the environment is possible as a result of decay of the containers, or inadvertent combustion, etc. Moreover in fuel reprocessing plants and fuel preparation plants, spent ion exchange resins contain significant amounts of plutonium as well as other fission products, which may preclude direct burial of these resins.

Inasmuch as a large percentage of the contaminated solid waste material is simply light-weight, bulky, combustible material, incineration of solid nuclear waste materials has been studied extensively, but it is subject to poor control of combustion, with attendant off-gas system difficulties and severe corrosion problems, coupled with expensive maintenance problems. Mechanical compaction of the solid waste material has also been studied extensively with volume reductions of two- to five-fold being achieved. In general, however, compaction and sorting of solid waste materials are moderately expensive in that special personnel protection devices are needed over and above normal protective equipment costs and these operations do not put the material into an inert form.

In another approach a process based on the use of sulfuric acid with a selenium catalyst has been used to reduce the volume of combustible, low level radioactive waste. This process is described in "Treatment of Combustible, Solid, Low Level Radioactive Waste at RISQ, the Danish Atomic Energy Commission Research Establishment", Proceedings of a Symposium on Practices in the Treatment of Low and Intermediate Level Radioactive Waste, IAEA and ENEA, Vienna, December, 1965. While this process affords volume reductions approaching 60, the process requires the use of a very toxic catalyst and apparently has poor control of the reaction rate.

An improved system for the digestion of low level radioactive solid waste material has been described in U.S. Pat. No. 3,957,676, issued May 18, 1976. In the patented process the waste material is digested by reacting the combustible, solid waste with concentrated sulfuric acid at a temperature within the range of 230° to 300° C. and simultaneously and/or thereafter contacting the reacted mixture with concentrated nitric acid or nitrogen dioxide. The process is conducted batchwise or by incremental additions of solid waste materials and nitric acid or nitrogen dioxide. While a significant improvement in volume reduction in the order of up to 160 can be achieved with very little acid consumed, the waste through-put rate is relatively low, because of the geometrical limitations that must be imposed when treating fissile containing materials and this detracts from its practical value.

It is therefore desirable, and a primary object of this invention, to provide an improved system to that described in U.S. Pat. No. 3,957,676, that has a controlled, safe, less expensive and more readily manageable form of treatment of low level radioactive, combustible, scrap material, with suitable volume reductions and a relatively high through-put.

SUMMARY OF THE INVENTION

In accordance with this invention an improved system for chemically digesting low level radioactive solid waste material is provided wherein the solid waste is reacted with concentrated sulfuric acid at a temperature within the range of 220° to 330° C. and simultaneously the reacting mixture is brought in contact with concentrated nitric acid or nitrogen dioxide. The improved system comprises an annular vessel (10) constructed to be substantially filled with the concentrated sulfuric acid. The waste material is introduced into the annular vessel and the nitric acid or nitrogen dioxide is added to the sulfuric acid while the sulfuric acid is reacting with the solid waste. Means (16) are provided for mixing the solid waste within the sulfuric acid so that the solid waste remains substantially fully immersed. During the reaction, the off gas and the product slurry residue are removed from the annular vessel. In one preferred form the means for mixing includes an air lift recirculator wherein mixing is provided by air used to oxidize the off gases and the nitric acid or nitrogen dioxide used to oxidize the carbon slurry residue. In another preferred form the vessel is constructed to retain the heat of the exothermic chemical reaction to substantially maintain the reaction temperature within the range of 220° to 330° C.

BRIEF DESCRIPTION OF THE DRAWING

For better understanding of the invention, reference may be had to the preferred embodiment, exemplary of the invention, shown in the accompanying drawing, which illustrates a schematic view of the apparatus of this invention.

DESCRIPTION OF THE PREFERRED EMBODIMENT

This invention provides an improved system for performing the process described in U.S. Pat. No. 3,957,676. In accordance with this invention a high-rate acid digester is provided which reacts the combustible waste with sulfuric acid in a well mixed reactor where the acid and waste are intimately mixed through the whole volume of the chemical reaction vessel without establishing critical concentrations of radioactive material. This contrasts with previous systems employed to carry out the patented process wherein the waste was either batch wise or incrementally added to a stagnant pool of acid. Furthermore, the system of this invention has the capability of providing a continuous throughout.

The apparatus of this invention basically includes a deep annular vessel 10, for example approximately 39 inches (1 meter) deep, having an outside diameter 14 of approximately 30 inches (0.76 meters) and an inside diameter 12 of approximately 24 inches (0.61 meters). The vessel includes a number of airlift circulators and gas bubblers 16 which extend from the top cover of the vessel 18 into and substantially through the annular cavity 17 to a depth well below the surface level of sulfuric acid, which substantially fills the cavity. An inlet conduit 20 is provided for permitting the introduction of solid waste material. The waste to be digested is funneled through inlet port 22 and is transported by a ram 24 to the inlet conduit 20 where it is distributed into the annular cavity of concentrated sulfuric acid.

The waste enters the top of the annular digester where the recirculators spray the acid solution over the waste at high flow rates. The action of the gas bubblers and the recirculators are designed to cause the waste to be swept under the surface of the hot sulfuric acid. Reaction of the waste with the acid produces a carbon slurry residue and an off gas mixture. The gas bubblers supply the air used to oxidize the off gases. Nitric acid or nitrogen dioxide is added to the reaction to oxidize the carbon slurry residue. The nitric acid or nitrogen dioxide can be introduced into the reaction through the recirculators or through a separate inlet 28 and can be added either incrementally or continuously at the rate required to fully oxidize the carbon slurry residue. The rate of addition can be established in advance of the reaction from the nature and volume of waste to be digested.

The intimate contact of the sulfuric acid with the reaction products facilitates a more complete and efficient reaction. It has been observed that significantly less energy input is needed to drive the waste/acid reaction of this invention than had previously been required by the prior art process.

Desirably, the reaction vessel is surrounded by a heating jacket 26 which includes auxiliary heating coils to maintain the reaction temperature within the permissible range of between 220° to 330° C. The rate of the reaction drops off significantly below 230° C., and much below 220° there is a possibility of the formation of nitrated compounds, which is undesirable. 200° C. therefore has proved to be a practical lower limit for carrying out the process. The upper limit of 330° C. is set to maintain the process below the boiling point of sulfuric acid. Preferably, the temperature is maintained at a value up to 260° C. The heating jacket, which functions in part as an insulator, retains the exothermic heat produced during the reaction to reduce the amount of energy that must be added to the process.

During the process the off gases are routed through a deentrainment unit 30 to recover any captured acid that might have been entrained, which can then be returned to the reaction cavity. Also, while the process is taking place, the product slurry 32 is drained on a regular basis so that the reaction may be carried on continuously. The slurry is routed to a recovery or residue ash disposal system.

Thus, the improved system of this invention increase the efficiency of the acid digestion process and provides a continuous through-put capability.

We claim:

1. An improved system for chemically digesting low level, radioactive, solid waste material comprising:

an annular vessel constructed to be substantially filled with concentrated sulfuric acid;

means for delivering the solid undigested waste into the annular vessel;

means for adding concentrated nitric acid or nitrogen dioxide to the sulfuric acid within the annular vessel while the sulfuric acid is reacting with the solid waste;

means for mixing the solid waste within the sulfuric acid so that the solid waste remains substantially fully immersed and fully dispersed;

means for removing off gas from the annular vessel; and means for removing product slurry residue.

2. The chemical digestion system of claim 1 wherein the means for adding the nitric acid or nitrogen dioxide continually adds the nitric acid or nitrogen dioxide at a preestablished rate.

3. The chemical digestion system of claim 2 wherein the preestablished rate of nitric acid or nitrogen dioxide addition is dependent upon the nature and volume of the solid waste being fed into the vessel.

4. The chemical digestion system of claim 1 wherein the vessel is constructed to retain the heat of exothermic chemical reactions occurring in the digestion process.

5. The chemical digestion system of claim 1 wherein the means for mixing includes an airlift recirculator wherein mixing is provided by air used to oxidize the off gases and the nitric acid or nitrogen dioxide used to oxidize the carbon slurry.

6. An improved method for chemically digesting low level radioactive, solid undigested waste material wherein the solid waste is reacted with concentrated sulfuric acid at a temperature within the range of 220° to 330° C. and the reacting mixture is simultaneously contacted with concentrated nitric acid or nitrogen dioxide, wherein the improvement comprises:

confining the sulfuric acid within an annular vessel;

delivering the solid waste into the sulfuric acid within the annular vessel;

adding the nitric acid or nitrogen dioxide to the waste/sulfuric acid mixture;

continuously mixing the solid waste within the sulfuric acid so that the solid waste remains substantially fully immersed and fully dispersed;

removing off gas from the annular vessel; and removing product slurry from the annular vessel.

7. The method of claim 6 wherein the off gas and product slurry are removed from the annular vessel substantially continuously as the waste is digested.

8. The method of claim 6 wherein the mixing is accomplished by airlift recirculation wherein mixing is provided by air used to oxidize the off gases and the nitric acid or nitrogen dioxide used to oxidize carbon product slurry.

* * * * *